US006893286B2

(12) United States Patent
Drewes et al.

(10) Patent No.: US 6,893,286 B2
(45) Date of Patent: May 17, 2005

(54) CONNECTOR APPARATUS ADAPTED FOR THE DIRECT PLUG-IN CONNECTION OF CONDUCTORS

(75) Inventors: Bjoern Drewes, Detmold (DE); Eckard Beins, Detmold (DE); Herbert Fricke, Detmold (DE); Joerg Richts, Schlangen (DE); Siegfried Storm, Schlangen (DE); Thomas Tappe, Detmold (DE); Udo Pruessner, Bad Salzuflen (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 10/835,332

(22) Filed: Apr. 30, 2004

(65) Prior Publication Data

US 2005/0042912 A1 Feb. 24, 2005

(30) Foreign Application Priority Data

Sep. 6, 2003 (DE) ..... 203 13 855 U
Mar. 11, 2004 (EP) ..... 04005764

(51) Int. Cl.[7] ..... H01R 11/20
(52) U.S. Cl. ..... 439/441
(58) Field of Search ..... 439/441, 436–440, 439/692–695, 852, 828, 834–835

(56) References Cited

U.S. PATENT DOCUMENTS 5,879,204 A 3/1999 Delarue et al.
5,938,484 A 8/1999 Beege et al.
5,975,940 A 11/1999 Hartmann et al.
6,056,585 A * 5/2000 Hatakeyama et al. ..... 439/441
6,261,120 B1 7/2001 Beege et al.
6,270,383 B1 8/2001 Wielsch et al.
6,280,233 B1 8/2001 Beege et al.
6,350,162 B1 2/2002 Despang
6,682,364 B2 * 1/2004 Cisey ..... 439/441
2002/0187670 A1 * 12/2002 Cisey ..... 439/441
2004/0077210 A1 * 4/2004 Kollmann ..... 439/441

FOREIGN PATENT DOCUMENTS

DE 35 14 097 C2 12/1996
DE 197 11 051 A1 9/1998
DE 202 06 763 U1 10/2002
DE 202 10 105 U1 11/2002
DE 101 30 074 A1 1/2003
DE 102 18 507 C1 5/2003

* cited by examiner

*Primary Examiner*—J. F. Duverne
(74) *Attorney, Agent, or Firm*—Lawrence E. Laubscher, Sr.; Lawrence E. Laubscher, Jr.

(57) ABSTRACT

An electrical connector arrangement includes a resilient contact adapted for direct engagement with the bare wire of an insulated conductor without the use of any assembly tool, characterized in that the resilient contact includes a first leg having a first end containing a window opening, a second leg having a first end extending at an acute angle through the window opening for clamping engagement with a conductor bare wire that is also inserted in the same direction therein, and a connecting portion connecting the other ends of the first and second legs to define a closed loop. A clamping edge at the extremity of the first end of the second resilient contact leg engages the bare wire and cooperates with a first edge of the window opening to prevent the withdrawal of the bare wire from the window opening. A conductive bus bar may be provided that includes a projecting portion that extends into the window opening between the bare wire and the window first edge, whereby the bare wire is clamped between the clamping edge of the second leg of the resilient contact and the bus bar projecting portion.

19 Claims, 12 Drawing Sheets

CONNECTOR APPARATUS ADAPTED FOR THE DIRECT PLUG-IN CONNECTION OF CONDUCTORS

BACKGROUND OF THE INVENTION

1. Field of the Invention

An electrical connector arrangement includes a resilient contact adapted for direct engagement with the bare wire of an insulated conductor without the use of any assembly tool, characterized in that the resilient contact includes a first leg having a first end containing a window opening, a second leg having a first end extending at an acute angle through the window opening for clamping engagement with a conductor bare wire that is also inserted in the same direction into the window opening, and a connecting portion connecting the other ends of the first and second legs to define a closed loop. A bus bar supports the resilient contact first leg and is provided with a projection that extends into the window opening between the conductor bare wire and the associated edge of the window opening.

2. Description of the Related Art

It is well known in the patented prior art to provide electrical connectors for connecting the bare wire at one end of an insulated conductor with a bus bar or the like, as evidenced by the prior patents to Delarue, et al., U.S. Pat. No. 5,879,204; Hartmann U.S. Pat. No. 5,975,940; Beege, et al., U.S. Pat. Nos. 5,938,484, 6,261,120, and 6,280,233; and Despang U.S. Pat. No. 6,350,162, among others. In these known devices, connection terminals for single-wire or multi-wire electrical conductors have been proposed in direct plug technology, where a bus bar with a recess and a collar engages a U-shaped resilient clamping contact. While, on the one hand, this arrangement provides for an easy assembly of the components, it does present the problem that one must exert a relatively large force when connecting or disconnecting the conductors on other components of the connection device, for example, as a bus bar or a housing formed from an insulating material.

The present invention was developed to avoid the above and other drawbacks of the known connector systems.

BRIEF SUMMARY OF THE INVENTION

Accordingly, a primary object of the present invention is to provide an improved electrical connector arrangement including a resilient contact having a horizontal first leg portion containing a window opening for receiving the bare wire end portion of an insulated conductor, a second leg portion extending at one end at an acute angle through said window opening and terminating in a clamping edge in clamped engagement with the bare wire, and a connecting portion connecting the other ends of the leg portions to define a closed loop. Thus, in this arrangement, the bare wire is directly introduced into the window opening of one leg of the resilient contact for clamped engagement by the contact other leg. The wire remains positively clamped to the contact until the second leg thereof is displaced to a released position by means of an auxiliary contact releasing tool, such as a screwdriver.

According to another object of the invention, a bus bar may be provided that has a portion which also extends into the window opening between the bare wire and the edge of the window opening remote from the second leg of the resilient contact, whereby the bare wire is biased laterally by the contact clamping leg into electrical contact with the bus bar.

According to another object of the invention, the first spring leg with the window-like recess is attached upon a bus bar or some other element, in particular, in an immovable fixed manner. Alternatively, one might also provide an arrangement where the first spring leg is spaced with respect to a bus bar leg.

The invention provides a connection device that at the very least consists of only one resilient clamping contact, which assumes the contacting function itself in an integral manner. The clamping spring here has a geometry analogous to that of a tension spring. But the difference resides in the fact that a conductor from the opposite side—that is to say, from the side of the resilient loop—is introduced without tools automatically into the window-shaped recess in order there, for example, to be clamped firmly between the clamping leg that passes through the window-shaped recess and the edge of the recess or a bus bar that also passes through the recess.

This plug-in direction of the conductor is partly basically also shown in the German patent No. DE 35 24 097 C2; but there, it was not recognized that in the case of many conductors, it is even possible to do without an activation depressor (in other words, an activation tool in terms of the claim) for the clamping spring and to use the latter in direct plug-in technique, especially when the spring leg is fixed with the recess (for example, on the bus bar or on an insulation material housing) and in contrast to the state of the art when the leg passing through the window is freely mobile.

The terminal, thus designed, can be switched from one side quite readily without any tools, whereas a conductor cannot again be taken out of it against the spring action without a tool. The terminal offers a high level of functional reliability with minimum costs and can be switched without any tools and can be disconnected with a tool.

It is conceivable that the bus bar display a recess that is bordered all around or that is open on one side and that helps when inserting a conductor end.

According to a further object of the invention, the connection device can also be arranged on a bus bar in various ways. This entails the need for using another part—the bus bar—but, on the other hand, it offers an advantage that must not be underestimated, in other words, the most suitable materials can be selected in each case for the spring and the contact of the bus bar. Whereas when one dispenses with the use of a bus bar, one must seek a material compromise; i.e., a material that has both good elastic properties and good contacting properties.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE INVENTION

Figure 1:
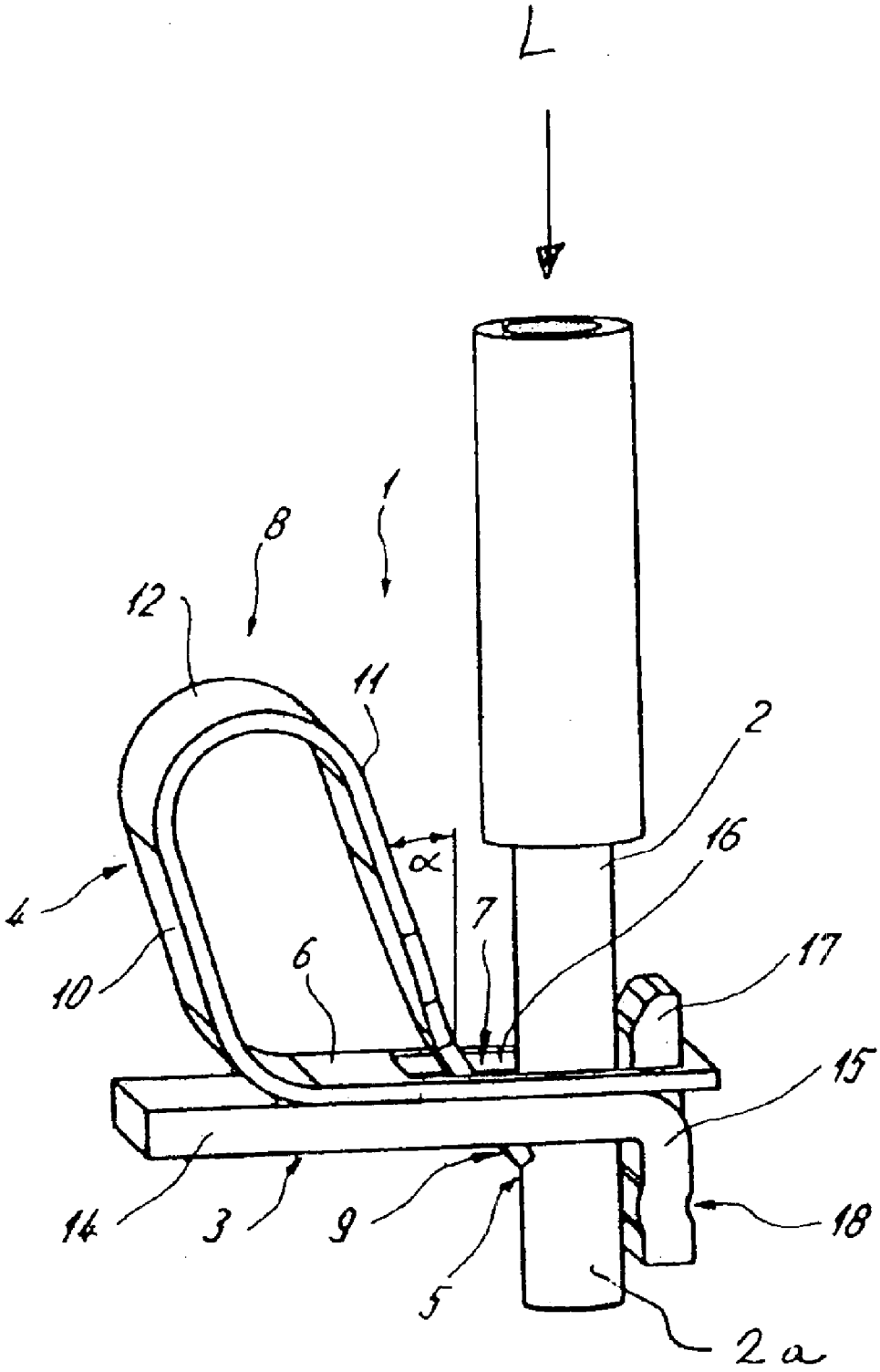
FIG. 1 is a front perspective view of a first embodiment of the electrical connector assembly of the present invention.

Referring first more particularly to FIG. 1, the connector arrangement 1 includes an insulated conductor 2 having a bare wire end portion 2*a*. A bus bar 3 is provided for supporting a resilient electrical contact 4 which serves as a pressure spring for firmly clamping conductor end 2*a* upon bus bar 3, the arrangement being so designed that conductor end 2 can be inserted directly into the clamping point 5 between resilient contact 4 and the bus bar without the use of any auxiliary insertion tool.

Resilient contact 4 has a first leg 6, which contains a window-like opening 7. Resilient contact 4 is mounted upon the bus bar with the first leg 6 above the window-like recess 7. Here, it is aligned parallel to the bus bar and it is placed upon it and/or attached upon it in a planar fashion. Alternatively, the first contact leg 6 can also be spaced at a distance away from the bus bar leg (as will be discussed below with reference to FIG. 4).

The resilient contact 4 includes a closed loop 8 that extends back toward the window-like recess 7 and passes through the latter with a free clamping or second leg 9, which in this case only has the width of the window opening. Free clamping leg 9 biases conductor bare wire end 2*a* against bus bar 3.

Loop 8 has a long-drawn-out shape with two almost extensively parallel-aligned spring legs 10, 11 as well as an arched portion 12 that connects the spring legs 10, 11 and is aligned so as to be inclined toward the conductor insertion direction L in such a way that angle $\alpha$ between the clamping leg and the conductor insertion axis will be smaller than 45°; i.e., and preferably, smaller than 30°.

Resilient contact 4 has a geometry corresponding with the geometry of a so-called leaf spring. It is so arranged and designed that a conductor can be inserted in it from the opposite side of the loop without any tool. A special advantage of this resilient contact 4 is that it permits a direct plug-in connection, because a conductor can readily be inserted into it, but it cannot readily again be pulled out against the edge in the areas of the clamping point 5. For this purpose, the user instead will need a tool to release the clamping leg 9. On the other hand, it also offers the advantage of a self-contained system, wherein the resilient contact 4 itself absorbs all forces between conductor end 2 and clamping spring 4. Here it is advantageous when resilient first leg 6 is fixed with recess 7 on bus bar 3.

Bus bar 3 has the shape of an L-shaped corner angle, where one of the two bus bar legs 14, 15 of bus bar 3 is used for the direct placement of the first spring leg 6 with the window-like opening 7 and itself has its own window-like opening 16, which is flush with the window-like opening 7 of the first resilient contact leg 6.

Preferably, the window-like opening 16 of bus bar 3 is formed by a punch-out step, in particular, in such a way that a bus bar piece 17 is still connected on one side with bus bar 3, which is so bent around that it extends or continues the bus bar leg 15 through opening 16. An outward bulge 18 in bus bar 3 in the region of clamping point 5 improves the contact between the bus bar and conductor bare end 2*a*.

Figure 2:
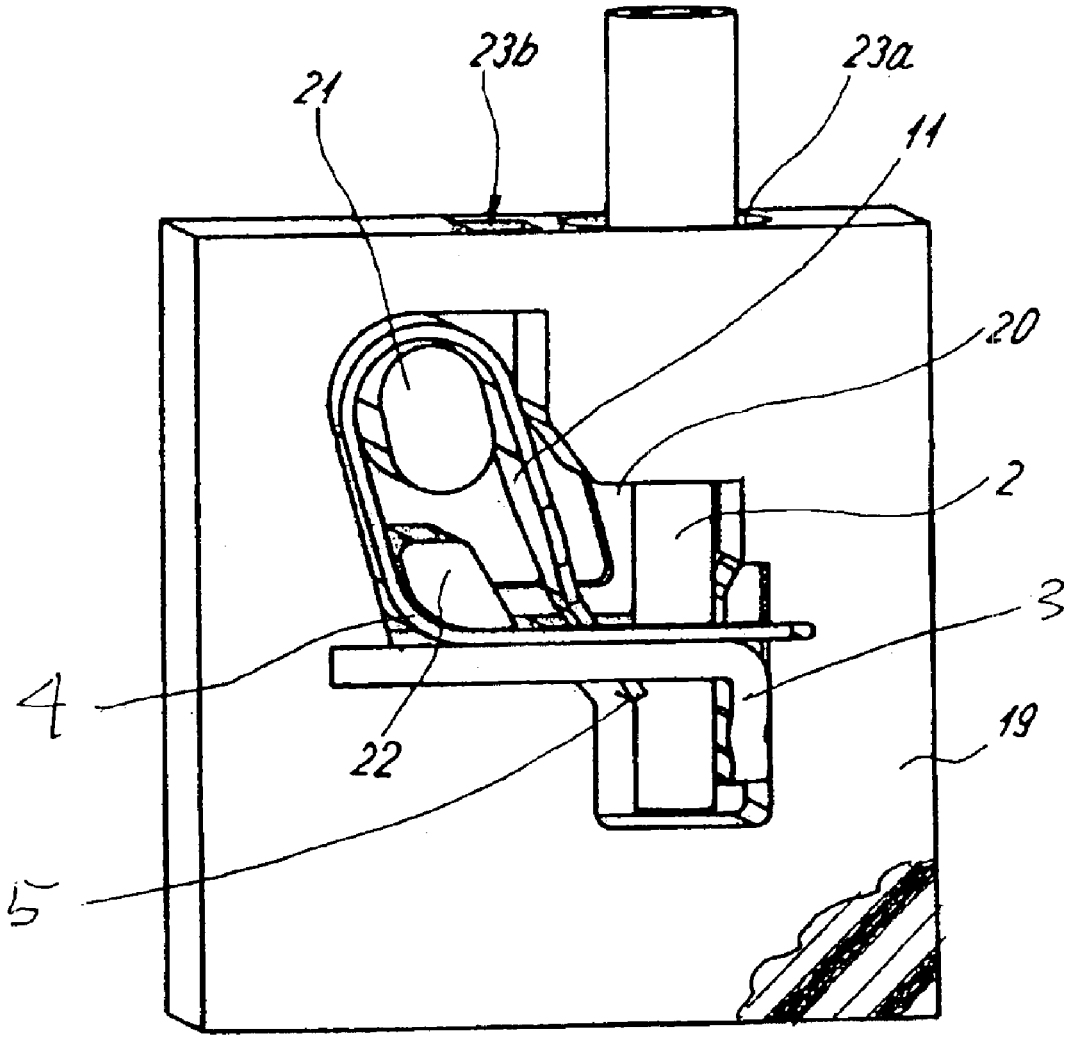
FIG. 2 is a perspective view of the invention of FIG. 1 mounted in a terminal housing.

FIG. 2 shows the arrangement of connection device 1 from FIG. 1 with a housing 19 formed of insulating material. This insulated housing 19 is provided with at least one Window or at least one recess 20 into which one or more connection devices are inserted laterally.

Housing support portion 21, 22 that pass through the interior of loop 8 are used to support the resilient contact or to act as abutments in order to fix contact 4 in the insulation material housing in a defined manner and to guarantee perfect operation as well as limitation of the resilient contact motion.

Figure 3:
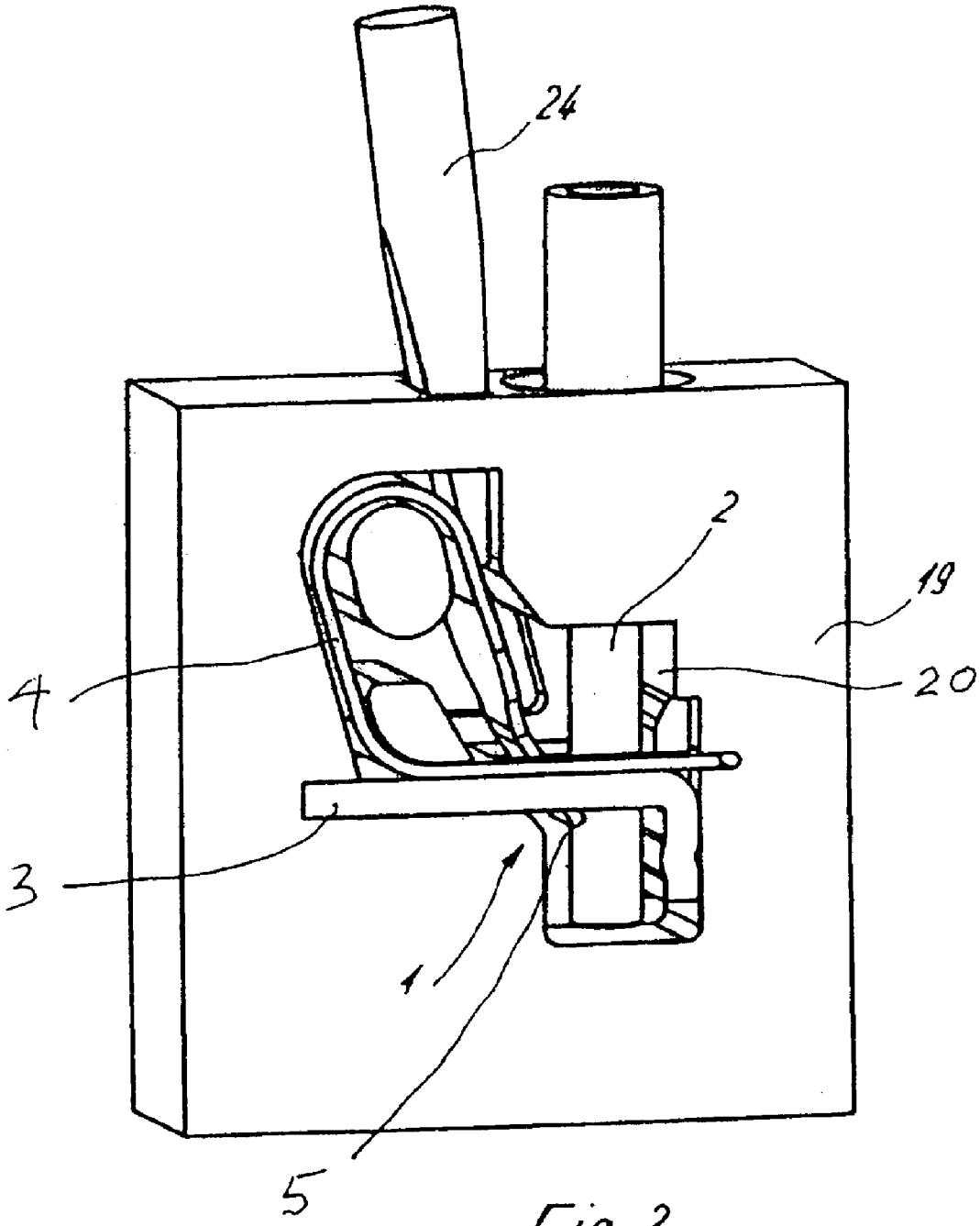
FIG. 3 is a perspective view corresponding to FIG. 2, illustrating the use of a disconnecting tool for releasing the clamping leg of the resilient contact of the assembly when mounted in the terminal housing.

A conductor insertion opening 23*a* is provided for inserting the conductor end 2*a* into the clamping point. An insertion opening 23*b*, on the other hand, is used to insert an operating tool 24 (FIG. 3) and thus makes it possible to disconnect the connection device, which in this arrangement, for example, can be used for a row or series of terminals.

In doing the wiring, conductor bare end 2*a* is simply pushed into the connection device through conductor insertion opening 22, as a result of which, the clamping leg 6 is so bent that clamping point 5 will be opened and that conductor end 2 can be inserted into clamping point 5 and can be fixed there.

By means of operating tool 24 (FIG. 3), made in the form of a screwdriver that is inserted into insertion opening 23*b*, it is now possible to bend clamping leg away from clamping point 5 so that it will now be possible to remove the conductor end 2 out.

Figure 4:
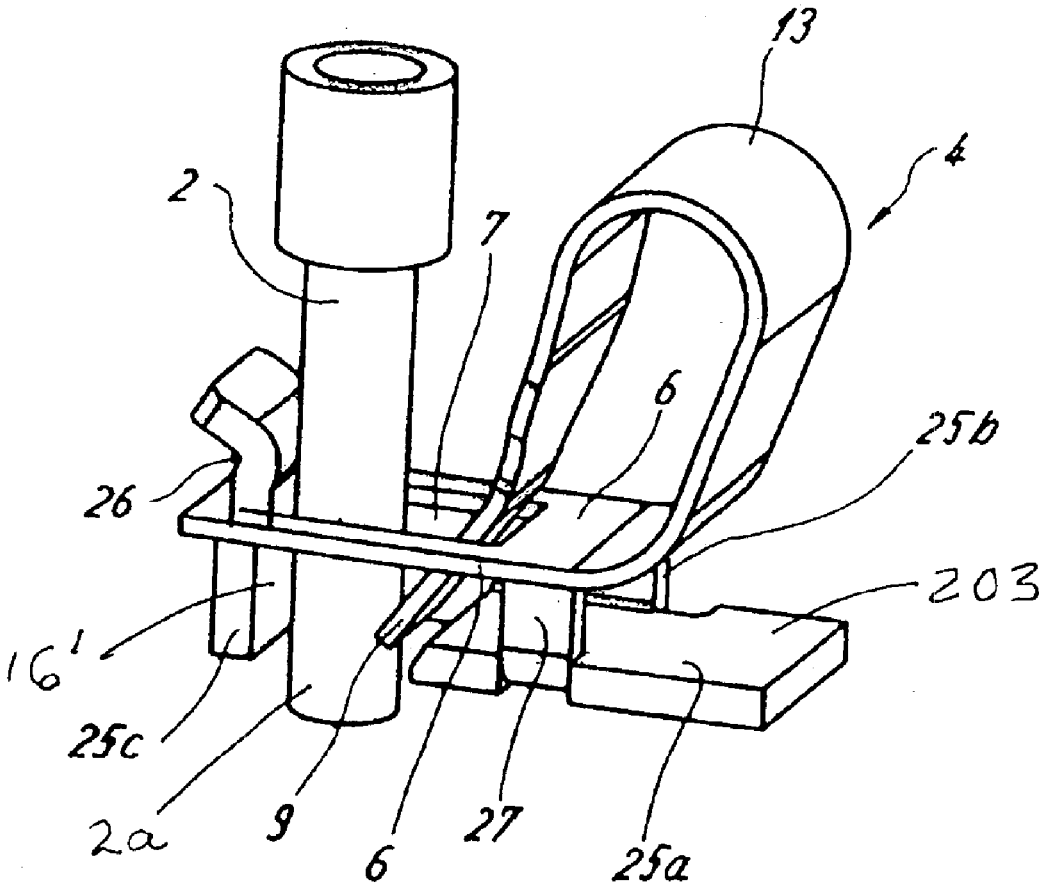
FIG. 4 is a front perspective view of a second embodiment of the connector assembly.
Figure 5:
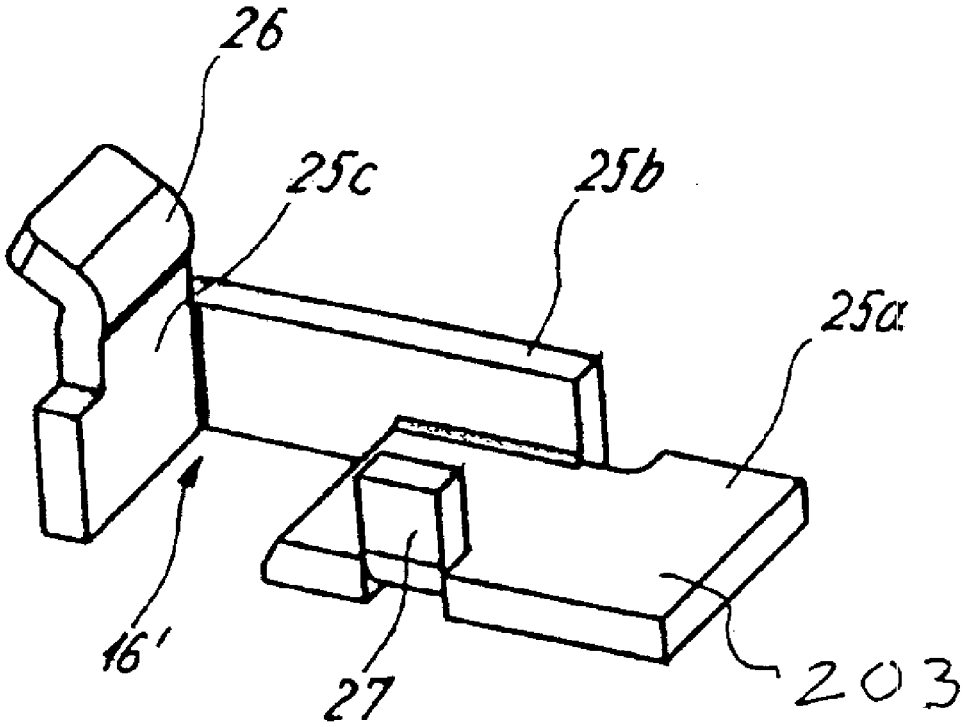
FIG. 5 is a detailed perspective view of the bus bar of FIG. 4.

According to a second embodiment of the invention illustrated in FIGS. 4 and 5, the first leg 6 of the resilient contact 4 is parallel with and spaced from the horizontal first portion 25*a* of the bus bar 203. This first contact leg is supported by vertically extending laterally spaced portions 25*b* and 27 that extend upwardly from opposite sides of the first bus bar portion 25*a*. The middle bus bar portion 25*b* is sufficiently bent by 90° for the transmission of sufficiently large currents and thus defines a side wall of the open recess 16' (which makes it easier to insert the conductor), whereupon due to its width and design, it makes it possible to transmit sufficiently large currents in that area. An outward bulge 26 is provided for contacting again on the bus bar leg portion 25*c* that is arranged opposite the clamping point 5.

In this case, resilient contact 4 is placed at an interval parallel to one of the bus bar legs 25*a*. The spacing is done by the bus bar segment 25*b* and a bridge 27 that, from the bus bar leg 25*a*, is bent upward in the direction of clamping spring 4 and spaces the latter with its free ends.

The particular advantage here resides in that the good current-transmitting property of bus bar 3' also in the area of recess 16', particularly by virtue of bus bar segment 25*b* to the side of the recess (or, in this case, sparing) 16', where one must also emphasize that this bus bar 3 can be made in a particularly favorable fashion as a punch-bending part.

Figure 6:
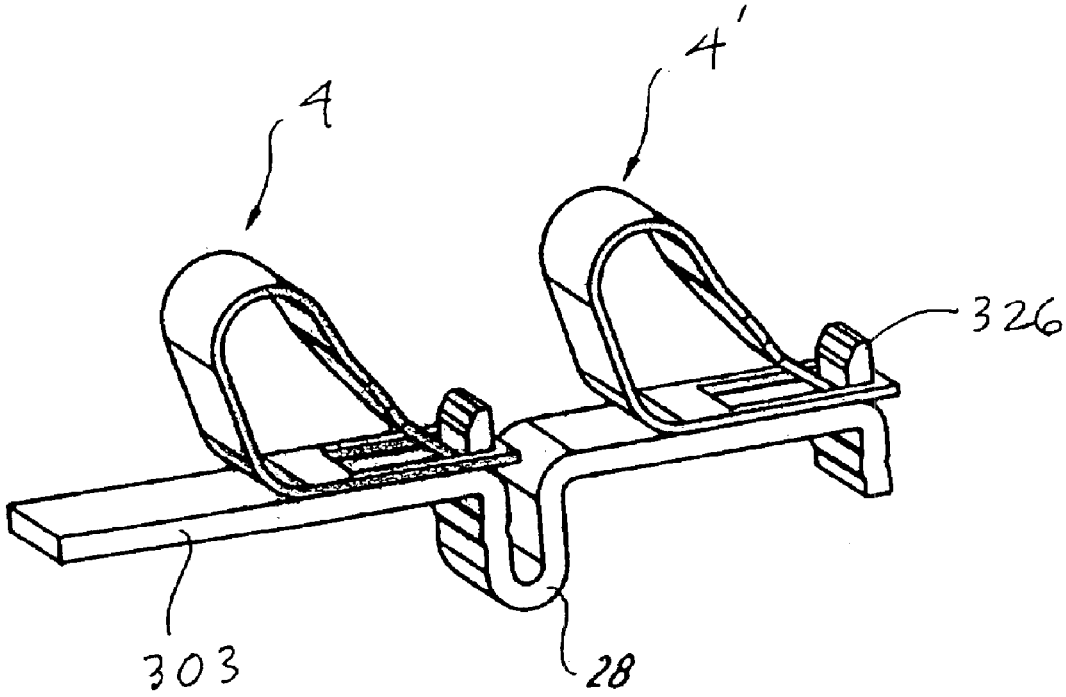
FIGS. 6–9 are perspective front views of third, fourth, fifth, and sixth embodiments, respectively, of the resilient contact connector assembly of the present invention.

Otherwise, using this direct connection spring, one can implement all variants in FIGS. 1 to 5, but, for example, also multiple connections in the manner of FIG. 6 with two connection devices 1, 1'.

In FIG. 6, the two connection devices are arranged on bus bar 303 in the manner of FIG. 1, which, however, is continued behind a fold 28 behind the first 4 up to a second 4'. Here, one can also see the position of 4 in the disconnected state.

Figure 7:
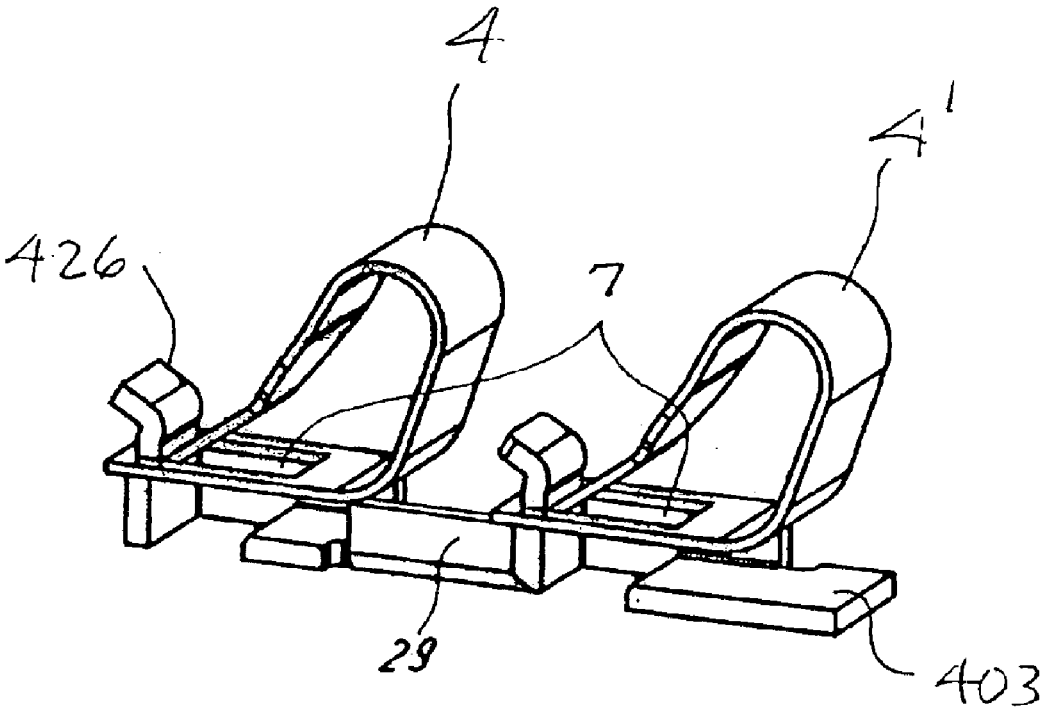

FIG. 7 shows a similar arrangement with bus bar 403, which, via a connecting bridge 29, connects two connection devices in one piece, where each is structured in the manner of FIGS. 4 and 5.

Figure 8:
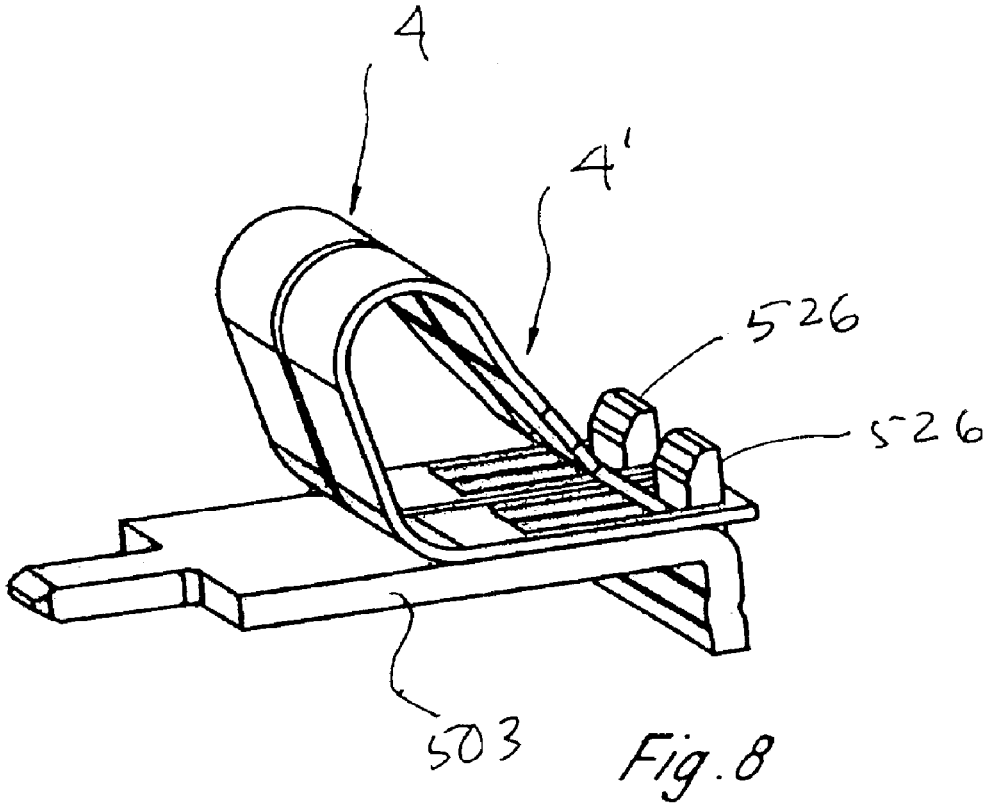

FIG. 8 again shows the corresponding arrangement of two resilient contacts 4,4' located parallel next to each other on a bus bar 503 that basically resembles the one in FIG. 1.

Figure 9:
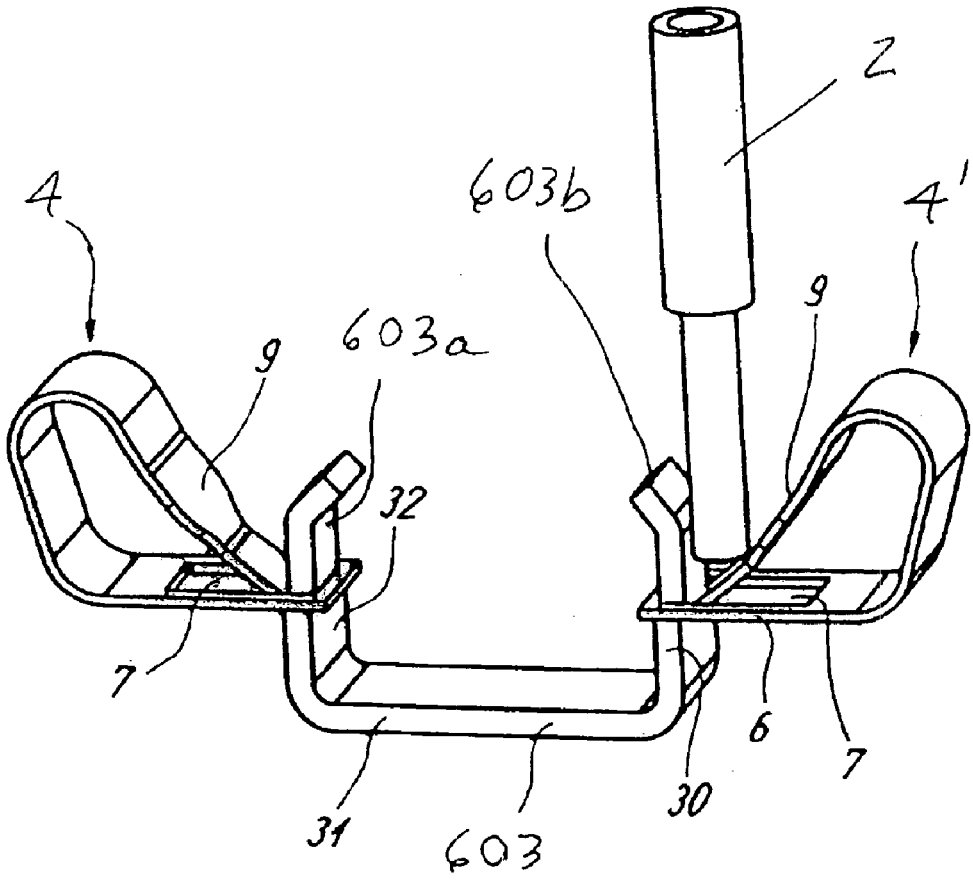

FIG. 9 again differs from this embodiment. Here, the two end portions 603*a*, 603*b* of bus bar 603 that at the terminal areas is in each case is stepped and bent in a U-shaped form pass perpendicularly through one recess 7 each in the first leg 6 of two resilient contacts 4 where resilient contacts 4 rest on the gradation steps. This variant offers the particular advantage that the conductors do not have to go through bus bar 3 at all, something that again makes it even easier to do the wiring. In particular, as one can see, a passage connection is particularly easy to make for another passage terminal 3, not shown. Otherwise, the arrangement again corresponds to the arrangement seen in FIG. 1.

Figure 10:
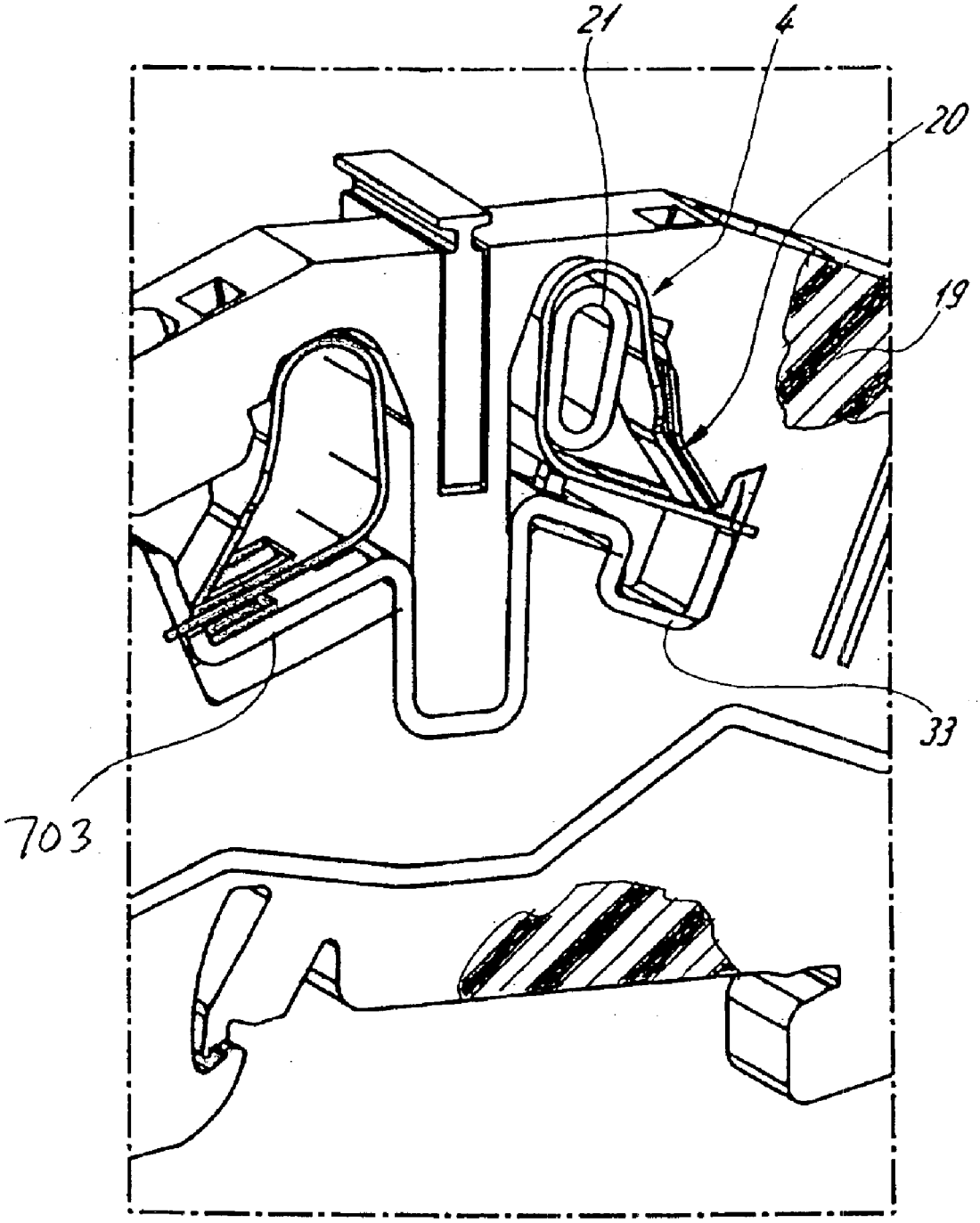
FIG. 10 is a detailed perspective front view of a seventh embodiment of the connector assembly mounted within the terminal housing.

FIG. 10 shows the arrangement of two additional connection devices with a spaced bus bar 703 in a terminal housing 19 where terminal housing 19 assumes an additional supporting function for the connection devices and where the bus bar of the connection device, shown on the right in this figure, additionally has a U-shaped receiving space 733 (made as a bend-out of the bus bar) in the direction of introduction for the reception of the conductor end. Again, at least one or several support portions 21, here in the right part of the figure where bridges pass through the interior of loop 8, are used to support the contact or serve as abutments in order to fix the resilient contact 4 in terminal housing 19 made of insulation material in a defined manner and to guarantee perfect operation.

Figure 11:
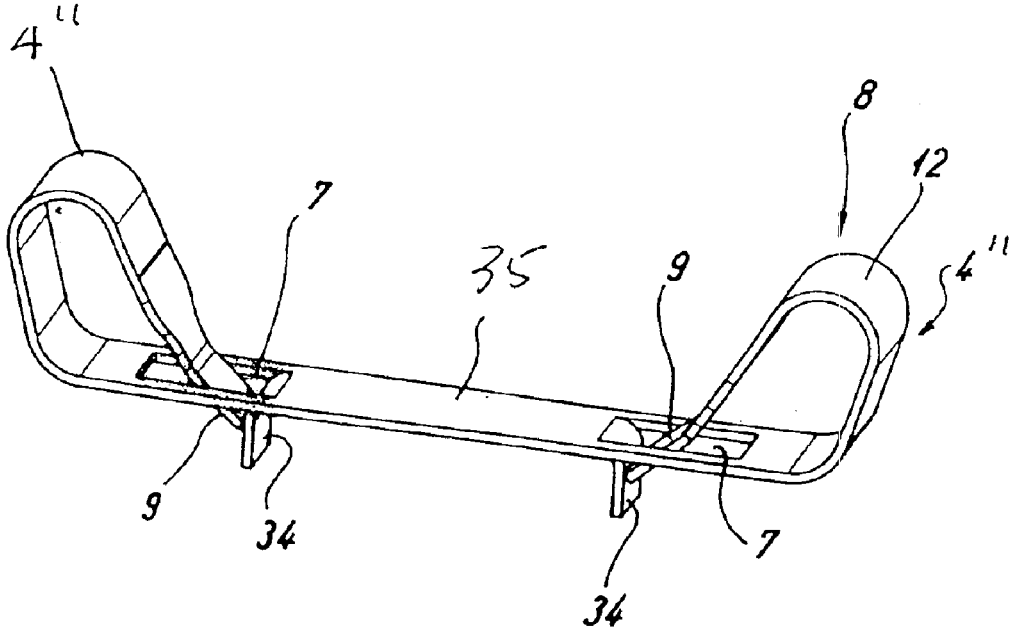
FIG. 11 is a perspective view of a dual-resilient-contact embodiment of the invention.

But it is also conceivable (not shown here) that one might do entirely without a separate bus bar 3 when one selects a sufficiently conducting resilient material to make the resilient contact 4 so that the joinder portion 35 of this material itself will act as the bus bar. For example, the area of the window-like recess 7 can also directly be fashioned as the end of a bus bar as shown in FIG. 11. This embodiment has a particularly simple structure with minimal cost and nevertheless provides an self-contained force system to receive the forces during the insertion and contacting of the conductor end 2 into clamping point 5. Additional support can again be provided by walls and/or bridges of an insulation housing material that is to be shaped correspondingly (not shown here). A more precise view in FIG. 1 shows that in this case, one resilient contact 4" each is made in the manner of FIG. 1 and is formed directly on one or both ends of a band-like resilient material with current conducting properties. As explained before, no separate bus bar is provided here. The resilient material instead itself works rather like a bus bar. Advantageously, when punching out the window-shaped recess 7, one allows one support portion 34 each to stay there, and after punching out the window, it is folded over on three sides and by about 90° out of the plane of the spring band so that a conductor would be clamped firmly between clamping leg 9 of resilient contact 4 and that support piece 34.

Figure 12:
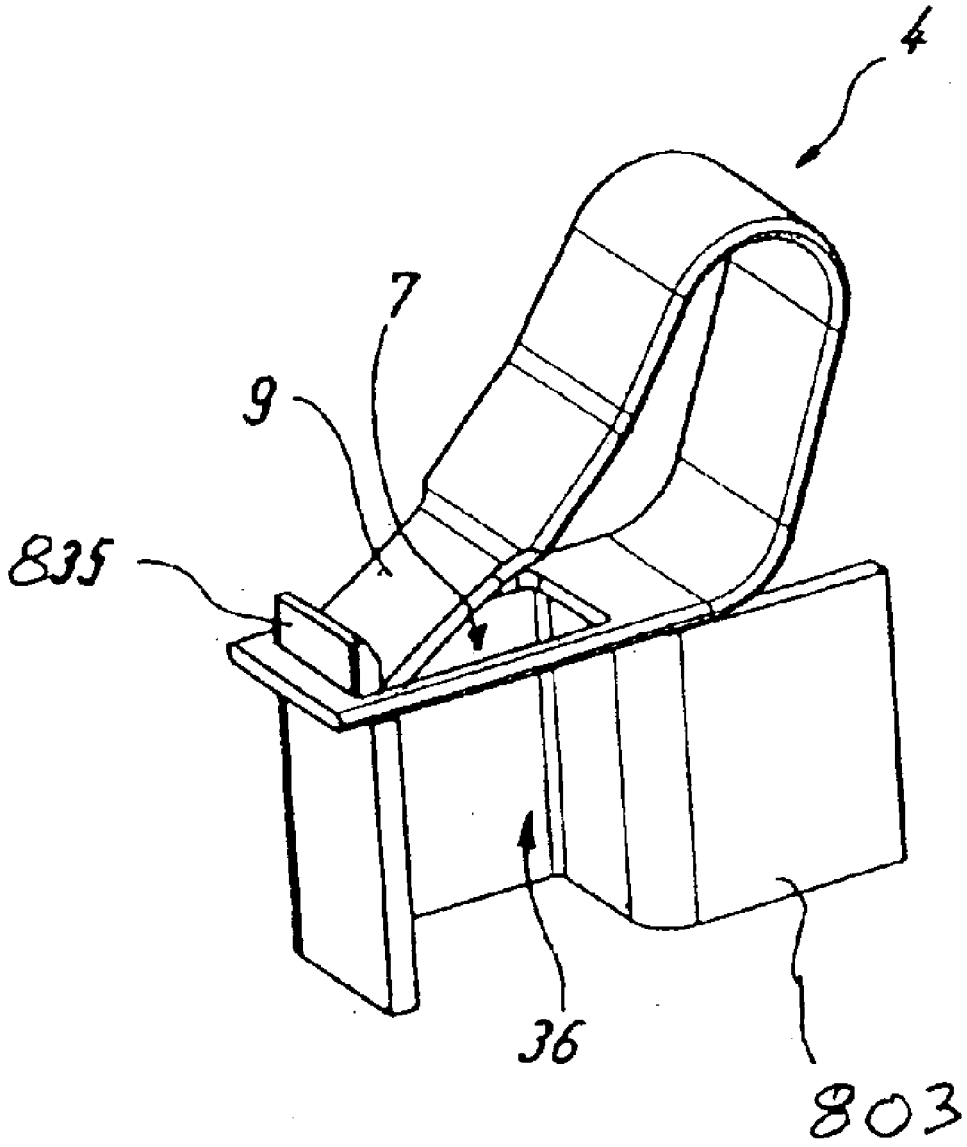
FIG. 12 is a perspective view of a further embodiment of the invention.

In the modification of FIG. 12, a bus bar 3, which consists of a current-conducting material strip that in its terminal area is several times so bent around especially by 90' toward clamping spring 4 that a kind of U-shaped space 36 is formed at the end of bus bar 803. On this U-shaped space, there is stuck laterally orthogonally with respect to the main plane of extent of the bus bar in the connection to the U one of the clamping springs 4 in the manner of FIG. 1 so that the interior space of the U-shaped space 36 will serve as receiving space for the conductor that is to be inserted. Recess 7 can have a bus bar pass through it from the side of the spring 4, which piece makes it easier to contact a conductor or that is used for contacting in cooperation with the clamping leg 9 of resilient contact 4. Clamping leg 9 has two bent off-sets against the direction of the bending of loop 8, which optimize the function.

This modification can be made in a particularly simple fashion in terms of construction and design and nevertheless offers good connection properties.

All variants in the figures above and the claims are basically suitable for use in or on insulation material housings 19 of terminal blocks or other connection units and modules, for example, also for use directly on or in electrical appliances of all kinds such as contactors and the like. All variants furthermore can also be made as multiple connections and one can also make additional bus bar geometries with the clamping spring shown here.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. An electrical terminal arrangement adapted for direct tool-less connection with the bare wire at one end of an insulated conductor, comprising:

(a) a resilient contact (4) including:

(1) a horizontal first leg portion (6) having a first end containing a window opening (7) for receiving the bare wire end portion of an orthogonally-arranged insulated conductor (2), said first leg portion having a second end;

(2) a second leg portion (9) having a first end extending through said window opening at an acute angle relative to a plane extending normal to and transverse of said first leg portion, said second leg first end terminating at a clamping edge (5), said second leg portion having a second end; and (3) connecting means connecting the second ends of said contact first and second leg portions to define the closed loop (8) of an outwardly expansible leaf-type compression spring;

(4) said second leg portion being resiliently biased toward said first end of said first leg portion, whereby when the conductor bare wire end portion is directly inserted into said window opening without the use of any insertion tool, said clamping edge is biased toward clamping engagement with the periphery of the conductor bare wire end portion.

2. An electrical terminal arrangement as defined in claim 1, and further including:

(b) a horizontal electrically conductive bus bar (3) supporting said resilient contact first leg portion.

3. An electrical terminal arrangement as defined in claim 2, wherein said bus bar includes a first portion (25*a*) having a surface that is parallel with and spaced from said resilient contact first leg portion.

4. An electrical terminal arrangement as defined in claim 1, wherein said connecting means is generally U-shaped and includes a pair of parallel arm portions (10,11) having first end portions that are connected by an arched portion (12), and second end portions that are connected with the second ends of said first and second leg portions, respectively, said first and second arm portions being arranged at an acute angle (a) relative to a plane that extends orthogonally transversely relative to said contact first leg portion.

5. An electrical terminal arrangement as defined in claim 2, wherein said bus bar contains a through opening (16) opposite said resilient contact window opening (7), said through opening being arranged to receive the conductor bare end.

6. An electrical terminal arrangement as defined in claim 2, wherein said bus bar contains a lateral side recess (16') opposite said resilient contact window opening, said side recess being arranged to receive the conductor bare end.

7. An electrical terminal arrangement as defined in claim 5, wherein said first resilient contact leg is secured to said bus bar with said window opening being arranged opposite said bus bar through opening.

8. An electrical terminal arrangement as defined in claim 5, wherein said bus bar has an orthogonal second portion (17) that extends into said resilient contact window opening on the opposite side of the bare wire from said clamping edge of said first contact leg portion.

9. An electrical terminal arrangement as defined in claim 3, wherein said bus bar includes at least one second portion (25*b*) that is orthogonally arranged relative to said first bus bar portion, said second portion having a free edge upon which said resilient contact first leg portion is supported in spaced parallel relation relative to said bus bar first portion.

10. An electrical terminal arrangement as defined in claim 9, wherein said bus bar includes a pair of said second portions (25*b*;27) extending upwardly from opposite sides of said bus bar first portion.

11. An electrical terminal as defined in claim 9, wherein said bus bar includes a third portion (25*c*) that is orthogonally arranged relative to said second bus bar portion, said third extending upwardly into said resilient contact window opening.

12. An electrical terminal arrangement as defined in claim 2, wherein a pair of said resilient contacts (4,4") are arranged in laterally spaced relation on said bus bar.

13. An electrical terminal arrangement as defined in claim 2, wherein a pair of said resilient contacts (4,4')are arranged in collinearly spaced relation on said bus bar.

14. An electrical terminal arrangement as defined in claim 13, wherein said bus bar contains a downwardly extending U-shaped portion (28) intermediate said spring contacts.

15. An electrical terminal arrangement as defined in claim 8, wherein said bus bar is generally L-shaped and includes a third portion (18) that extends orthogonally from said first bus bar portion in the opposite direction relative to said second bus bar portion.

16. An electrical terminal arrangement as defined in claim 2, and further including:

(c) a terminal housing (19) formed of insulating material and containing a recess (20) in which said resilient contact and said bus bar are mounted.

17. An electrical terminal assembly as defined in claim 2, wherein said bus bar (803) consists of a plurality of orthogaonally arranged vertical panels having upper edges supporting said resilient contact first leg portion, said panels being arranged to define a recess (36) beneath said resilient contact first leg window opening.

18. An electrical terminal arrangement as defined in claim 16, wherein said bus bar includes a portion (835) that extends upwardly into said resilient contact first leg window opening.

19. An electrical terminal arrangement as defined in claim 1, wherein a pair of said resilient contacts are arranged in opposed end-to-end relation, and further including a joinder portion (35) joining the adjacent first ends of said resilient contact first leg portions.

* * * * *